United States Patent [19]

Förster et al.

[11] 4,121,820

[45] Oct. 24, 1978

[54] CONTROL SYSTEM FOR THE SHEET-FEEDING UNIT AND SHEET-PRESENTING UNIT OF A PRINTING MACHINE

[75] Inventors: Karl-Heinz Förster, Dresden; Werner Lein, Radebeul; Henner Hettmann, Coswig, all of German Democratic Rep.

[73] Assignee: Veb Polygraph Leipzig Kombinat für Polygraphische Maschinen und Ausrüstungen, Leipzig, German Democratic Rep.

[21] Appl. No.: 785,359

[22] Filed: Apr. 7, 1977

Related U.S. Application Data

[63] Continuation of Ser. No. 777,922, Mar. 15, 1977, abandoned.

[30] Foreign Application Priority Data

Mar. 15, 1976 [DD] German Democratic Rep. ... 191835

[51] Int. Cl.[2] ..... B65H 7/02

[52] U.S. Cl. ..... 271/259; 271/263

[58] Field of Search ..... 271/258, 259, 261, 263, 271/227

[56] References Cited

U.S. PATENT DOCUMENTS

| | | | |
|---|---|---|---|
| 3,626,956 | 12/1971 | Sander | 271/259 X |
| 3,709,485 | 1/1973 | Acquaviva | 271/259 |

*Primary Examiner*—Richard A. Schacher
*Attorney, Agent, or Firm*—Michael J. Striker

[57] ABSTRACT

The sheet-presenting unit presents received sheets to the printing instrumentality of the machine. The sheet-feeding unit feeds sheets to the sheet-presenting unit. The two units have activators which can be enabled and disenabled. The operator of the machine initiates a start signal. A sheet detector generates missing-sheet, skew-sheet and muliplee-sheet signals, indicating the condition of the sheet at the sheet-presenting unit. Enablement stages determine whether the activators for the feeding and presenting units are to be enabled or not. When the activators are enabled, the start signal is automatically extinguished. A logic circuit receives the start signal and the signals from the sheet detector. The logic circuit has pre-start-up and post-start-up modes of operation, corresponding to generation and termination of the start signal. In the pre-start-up mode, it permits the feeding-unit and presenting-unit activators to become enabled when it receives a missing-sheet signal, and also if it detects the concurrent absence of the several types of bad-sheet signals. In the post-start-up mode, it maintains the feeding-unit and presenting-unit activators enabled so long as it continues to detect the concurrent absence of the several types of bad-sheet signals.

9 Claims, 8 Drawing Figures

| | STATE OF START-UP FLIP-FLOP 2 | STATE OF FEEDING-UNIT FLIP-FLOP 9 | OUTPUT OF DETECTOR STAGE | OPERATION PERFORMED | SITUATION |
|---|---|---|---|---|---|
| PRE-START-UP CONDITIONS | SET | RESET | "MISSING SHEET" | SET FEEDING-UNIT FLIP-FLOP 18 ($C_3$) | 1 |
| | SET | RESET | "SKEW SHEET" | RESET START-UP FLIP-FLOP 2 | 2 |
| | SET | RESET | NEITHER "MISSING SHEET" NOR "SKEW SHEET" | SET PRESENTING-UNIT FLIP-FLOP 18 ($C_2$) THEREAFTER, SET FEEDING-UNIT FLIP-FLOP 9 ($C_3$) | 3 |
| POST-START-UP CONDITIONS | RESET | SET | "MISSING SHEET" OR "SKEW SHEET" | RESET PRESENTING-UNIT FLIP-FLOP 18 ($C_2$) THEREAFTER, RESET FEEDING-UNIT FLIP-FLOP 9 ($C_3$) | 4 |
| | RESET | SET | NEITHER "MISSING SHEET" NOR "SKEW SHEET" | SET PRESENTING-UNIT FLIP-FLOP 18 ($C_2$) THEREAFTER, SET FEEDING-UNIT FLIP-FLOP 9 ($C_3$) | 5 |

FIG. 8

CONTROL SYSTEM FOR THE SHEET-FEEDING UNIT AND SHEET-PRESENTING UNIT OF A PRINTING MACHINE

CROSS-REFERENCE TO RELATED APPLICATION

The present application is a continuation of our earlier copending application Ser. No. 777,922, filed Mar. 15, 1977 and now abandoned.

BACKGROUND OF THE INVENTION

The present invention relates to an arrangement for the automatic control of the operation of the sheet-feeding unit and sheet-presenting unit of a printing machine in dependence upon the position of sheets in the sheet-presenting unit as determined by sensing devices.

In the operation of a printing machine of the type in question, the sheets to be printed are fed to the machine by a sheet-feeding unit. The feeding unit picks the sheets to be printed off of a stack of such sheets and feeds them to the actual sheet-presenting unit of the printing machine proper via, for example, an inclined feed table provided with conveyor belts. Conventionally, the transport of sheets is initiated by means of an activator element, such as a start button. The monitoring of the sheets in the sheet-presenting unit of the printing machine proper is performed by means of sensing devices. When the sensing devices detect the presence in the sheet-presenting unit of a properly positioned sheet (hereinafter referred to as a good sheet), the sheet-presenting unit is enabled for activation. When the sensing devices detect the presence in the sheet-presenting unit of no sheet (hereinafter referred to as a missing sheet), an improperly positioned sheet (hereinafter referred to as a skew sheet), or a plurality of superimposed sheets stuck together (hereinafter referred to as a multiple sheet), the sheet-feeding unit is automatically shut off, and the sheet-presenting unit of the printing machine proper is shut off or disabled so that it cannot be activated; this is disclosed for example in German Democratic Republic Pat. No. DL 68,691, the entire disclosure of which is incorporated herein by reference. Hereinafter, the expression bad sheet is employed to refer, generically, to a missing sheet, a skew sheet, or a multiple sheet.

A disadvantage of these known automatic control systems is that, when the operator presses the start button for the sheet-feeding unit, the sheet-feeding unit commences to operate, irrespective of whether the sheet present in the sheet-presenting unit of the printing machine proper is a good sheet, or one of the aforementioned three types of bad sheet, i.e. irrespective of whether the proper conditions for start-up actually exist.

Another disadvantage of these known automatic control systems is that, after the start-up of the sheet-feeding unit and sheet-presenting unit, if a bad sheet is detected as being present in the sheet-presenting unit, the sheet-feeding unit is always shut off in automatic response. This occurs irrespective of the fact that, the detected bad sheet often becomes converted into a good sheet. For example, if the bad sheet is a skew sheet, the leading end of the next sheet often straightens out the skew sheet, converting it into a good sheet.

SUMMARY OF THE INVENTION

It is a general object of the invention to provide a control system which controls the operation of the sheet-feeding unit which feeds sheets to a sheet-presenting unit of the printing machine proper, and which also controls the operation of the sheet-presenting unit, in dependence upon the detection of good sheets and bad sheets at the sheet-presenting unit, but in a manner different from the prior art. In particular, it is an object to establish two sets of operating conditions, one for start-up, the other for operation subsequent to start-up, with the sets of operating conditions being prerequisite to the actual initiation of start-up, on the one hand, and to the continuance of operation subsequent to start-up, on the other hand, with the automatic control system being designed to implement the two sets of prerequisite conditions.

It is a more particular object to devise sets of prerequisite conditions which optimize the start-up and subsequent operation of the sheet-feeding and sheet-presenting units, and which minimize the degree of human supervision required for start-up and subsequent operation.

According to one advantageous concept of the invention, a detector generates missing-sheet and skew-sheet signals, and these are applied to a logic circuit. When the machine operator commands start-up, for example by pressing a button, the logic circuit receives a start signal, informing it that it should operate in its pre-start-up mode. In this mode, it permits activation of the sheet-feeding and sheet-presenting units in response to the receipt of a missing-sheet signal, and also in response to the concurrent non-receipt of missing-sheet and skew-sheet signals (equivalent to a good sheet signal). When the logic circuit determines that start-up should be permitted, the sheet-feeding and sheet-presenting units become enabled for operation, and the start signal is automatically terminated. Upon termination of the start signal, the logic circuit changes over into its post-start-up mode of operation, during which it determines whether sheet transport subsequent to start-up should be permitted to continue. In its post-start-up mode of operation, the logic circuit permits operation of the sheet-feeding and sheet-presenting units to continue only in response to the detection of good sheets. Advantageously, the logic circuit receives only various types of bad-sheet signals, and evaluates the concurrent absence of all the plurality of types of bad-sheet signals as being indicative of a good sheet.

According to another advantageous concept of the invention, the post-start-up mode of operation of the logic circuit is modified. If during post-start-up operation a skew sheet or a multiple sheet is detected, the logic circuit causes the activating means for the sheet-feeding and sheet-presenting units to become disabled, but additionally readies the control system for a renewed start-up. This readiness for a renewed start-up is permitted to last for a time period corresponding to a preselected number (one or greater than one) of operating cycles of the sheet-feeding unit, for example expressed in terms of the number of revolutions of a one-revolution coupling which drives the sheet-feeding unit. If during this limited time period, the detected skew sheet or multiple sheet becomes converted into a good sheet, then the renewed start-up actually occurs, i.e. the activating means of the sheet-presenting and sheet-feeding units are re-enabled. If during this limited time period the bad sheet does not convert to a good sheet, the readiness of the control system for the renewed start-up ceases.

According to another concept of the invention, the post-start-up mode of operation of the logic circuit is modified to provide for operator intervention. The control system is provided with an indicator which indicates the sheet condition detected by the detector (skew sheet, etc.). If during post-start-up operation a bad sheet is detected, the activating means for the sheet-feeding and sheet-preventing units are disabled by the logic circuit. Additionally, however, the logic circuit causes the sheet-condition detector to display on the indicator the condition of the bad sheet for a limited time period subsequent to the original detection of the bad sheet; here, again, this limited time period corresponds to a preselected number (one or greater than one) of operating cycles of the sheet-feeding unit, expressed in terms of the number of revolutions of the one-revolution coupling driving the feeding unit, if the unit is so driven. If during this limited time period the bad sheet converts to a good sheet, the operator can see this from the indicator; likewise, if there is no conversion to a good sheet, the operator sees this, too. The operator will then deal with the situation in accordance with his judgement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 tabulates the pre-start-up and post-start-up conditions followed by the disclosed control system.

DESCRIPTION OF THE PREFERRED EMBODIMENTS

Figure 1:
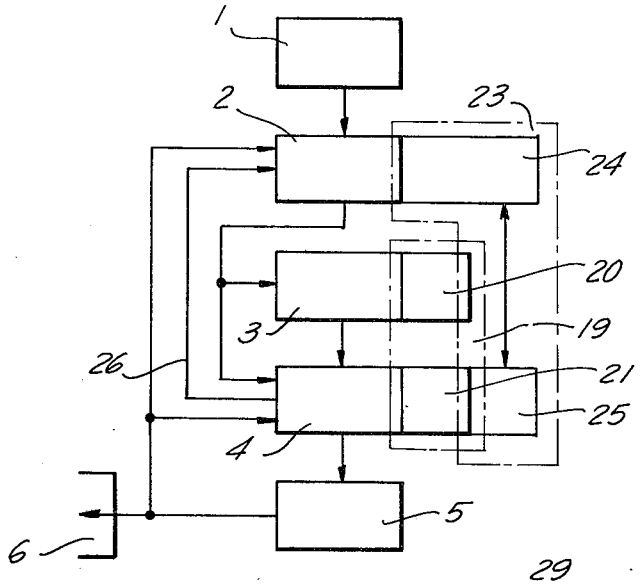
FIG. 1 is a simplified circuit diagram of an exemplary sheet transport control system, showing the base control system and two expansions of the system.

FIG. 1 depicts simplified schematic circuit diagram of one sheet transport control system according to the present invention. The control system includes a starter 1, activatable by a human operator, a start-up flip-flop 2, a missing sheet and skew sheet detector stage 3 which furnishes signals indicative of the position of the sheet in the sheet-presenting unit of the printing machine, a logic circuit 4 which implements sets of operating conditions prerequisite to start-up and operation subsequent to start-up, and a feeding unit and presenting-unit enablement flip-flop stage 5 for the sheet-feeding and sheet-presenting units.

The logic circuit 4, which implements the sets of conditions prerequisite to start-up and prerequisite to continuance of operation subsequent to start-up, processes the signals furnished by detector stage 3 (indicative of good sheets, missing sheets or skew sheets located at the sheet-presenting unit), the signals furnished by the start-up flip-flop 2, and also the signals furnished by the enablement stage 5 of the sheet-feeding and sheet-presenting units, and in dependence upon the results of such signal processing controls the states of the flip-flops within the enablement stage 5, in a manner described in detail below.

The enablement stage 5 for the sheet-feeding and sheet-presenting units is connected to the start-up flip-flop 2 and to the activating means for the sheet-presenting unit within the printing machine and for the sheet-feeding unit.

Figure 2:
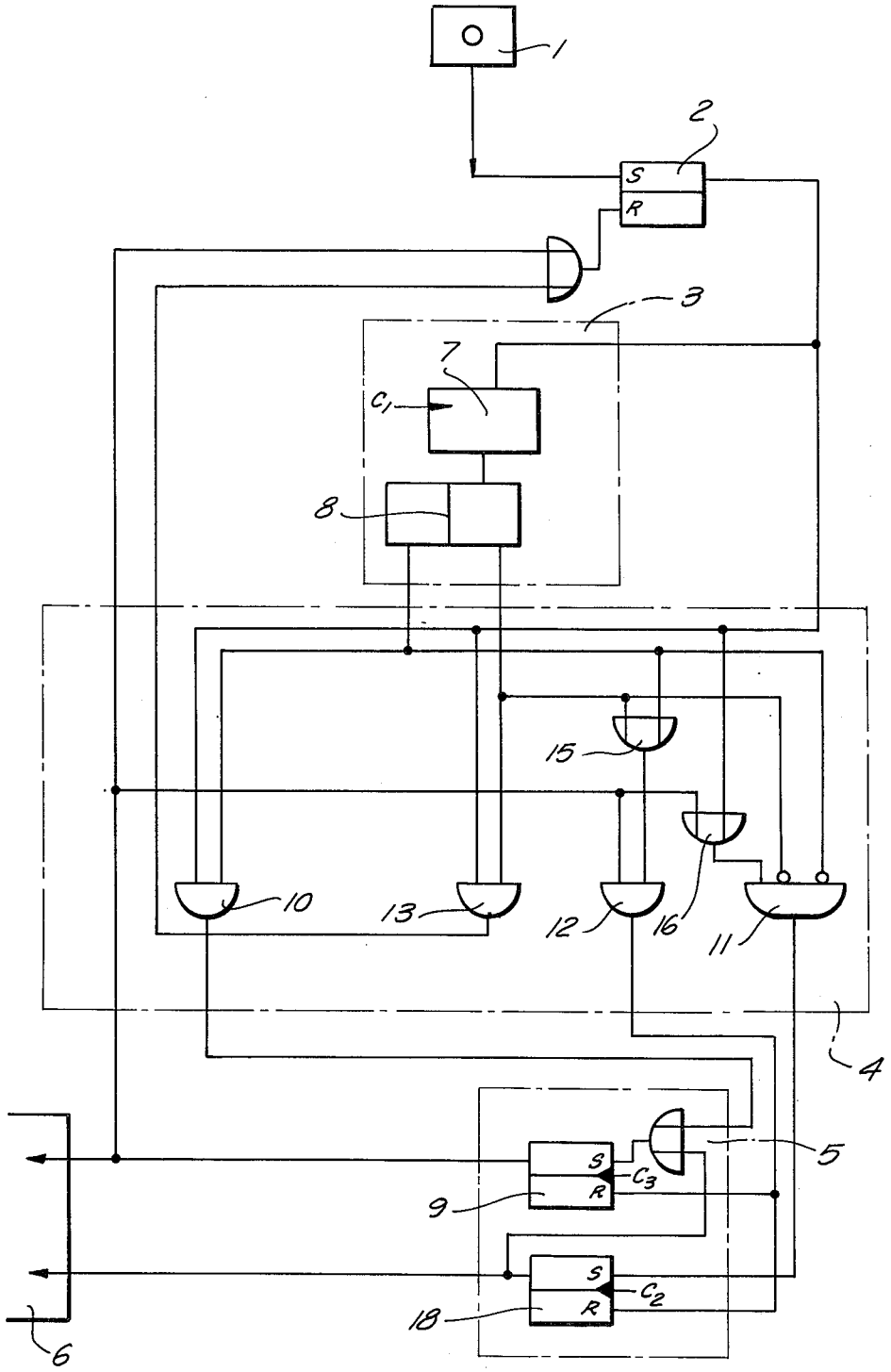
FIG. 2 is a detailed circuit diagram of the base control system shown in FIG. 1.

FIG. 2 depicts in detail the circuitry of the part of the system of FIG. 1 described above.

The operation of the control system circuit of FIG. 2 is as follows:

Depression of the start button 1 sets the start-up flip-flop 2. Start-up flip-flop 2, when in the set state, enables the clocked missing-sheet and skew-sheet measuring stage 7 for clocked operation, and stage 7 thereafter remains enabled. The measuring stage 7 is comprised of per se conventional detector devices operative for sensing the absence or presence and position of a sheet at the sheet-presenting unit of the printing machine proper. The signal generated by measuring stage 7, and indicative of such conditions, is generated in synchronism with the operation of the printing machine and of the sheet-feeding and sheet-presenting units thereof. Specifically, stage 7 furnishes a new output signal each time that it receives a clock pulse $C_1$. The output signal furnished by stage 7 is applied to a missing-sheet and skew-sheet evaluating stage 8, which processes the output signal of stage 7 and assumes one or the other of two states. When stage 7 detects the presence of a missing sheet (i.e., the absence of a sheet) at the sheet-presenting unit of the machine, stage 8 assumes the state thereof when a "1" signal is present on its left output line and a "0" signal on its right output line. When stage 7 detects the presence of a skew sheet at the sheet-presenting unit of the machine, stage 8 assumes the state thereof wherein a "0" signal is present on its left output line and a "1" signal on its right output line. Accordingly, the left and right output lines of stage 8, are, respectively, the missing-sheet signal output and the skew-sheet signal output of the stage. Stage 8 has a third state, in which "0" signals are present on both its output lines. This third state is assumed when neither a missing sheet nor a skew sheet has been detected at the sheet-presenting unit of the printing machine — i.e., when a good sheet has been detected.

The sensors utilized in stage 7 and their interconnection with stage 8 are per se conventional and do not form part of the present invention as such.

The control system circuit of FIG. 2 additionally includes a logic circuit 4 which implements two sets of conditions. One set of conditions is prerequisite to start-up of the sheet-feeding and sheet-presenting units; the other set of conditions is prerequisite to the continuance of operation of those units subsequent to start-up.

The circuit of FIG. 2 additionally includes the feeding-unit and presenting-unit enablement stage 5 of FIG. 1. Stage 5 is essentially comprised of an enablement flip-flop 9 for the sheet-feeding unit, and an enablement flip-flop 18 for the sheet-presenting unit of the printing machine proper.

When feeding-unit enablement flip-flop 9 is in the set state thereof, the sheet-feeding unit of the printing machine 6 is activated, or enabled for activation by a subsequent activating signal furnished by a mechanical synchronizer. When presenting-unit enablement flip-flop 18 is in the set state thereof, the sheet-presenting unit of the printing machine 6 is activated, or enabled for activation by a subsequent activating signal furnished by a mechanical synchronizer.

Logic circuit 4 receives the missing-sheet and skew-sheet signals from stage 8, the start signal from start-up flip-flop 2, and also the output signal of feeding-unit enablement flip-flop 9, logically evaluates those signals, and in dependence upon the result of the evaluation controls the states of the feeding-unit enablement flip-flop 9 and of the presenting-unit enablement flip-flop 18.

In the embodiment of FIG. 2, logic circuit 4 is capable of distinguishing among five different combinations of signals, representing five different situations, relating to whether start-up should or should not be permitted to commence and relating to whether operation subsequent to start-up should or should not be permitted to continue.

These five situations which logic circuit 4 is capable of distinguishing are discussed as follows:

SITUATION 1

Start-up has been commanded, but no sheet is present in the sheet-presenting unit of the printing machine. Specifically:

The operator has pressed the start button 1, causing start-up flip-flop 2 to assume its set state.

Stage 8 produces a "1" signal on its missing-sheet (left output).

A first AND-gate 10 receives the "1" signals from flip-flop 2 and stage 8 and produces an output "1" signal. This "1" signal indicates that start-up of the sheet-feeding unit has been commanded, but that no sheet is present at the sheet-presenting unit.

The output "1" signal from AND-gate 10 is applied to the set input of feeding-unit enablement flip-flop 9. This signal does not immediately set the clocked flip-flop, but does so once the flip-flop 9 receives a clock pulse at its clock input $C_3$.

Flip-flop 9, now in its set stage, produces a "1" output signal.

This "1" signal is transmitted to the activating means of the sheet-feeding unit, and operation of the latter is permitted to commence.

The "1" output signal of feeding-unit enablement flip-flop 9 is also applied to the reset input of start-up flip-flop 2, thereby resetting the latter. Thus, in this embodiment, start-up flip-flop 2 is in its set state only until such time as start-up of the feeding unit, in response to depression of start button 1, actually commences. Flip-flop 2 otherwise remains in its reset state.

The "1" output signal of flip-flop 9 is additionally applied to the logic circuit 4, enabling and disabling various gates therein (in a manner described below) to effect a switchover of the operation of logic circuit 4.

Now that logic circuit 4 has permitted the commanded start-up to actually commence, logic circuit 4 switches over to thereafter determine whether to permit or prevent continuance of operation subsequent to start-up (in a manner described below).

Summarizing with respect to Situation 1: The operator presses the start button 1, to command start-up. The absence of a sheet at the sheet-presenting unit of the printing machine is detected. The sheet-feeding unit commences its operation, and thus sheet transport has been initiated.

SITUATION 2

Start-up has been commended, but a skew sheet is present in the sheet-presenting unit of the printing machine. Specifically:

The operator has pressed the start button 1, causing start-up flip-flop to assume its set state, producing a "1" signal (start signal) at its output.

Stage 8 produces a "1" signal (skew-sheet signal) at its right output.

A fourth AND-gate 13 receives the two "1" signals (the start signal and the skew-sheet signal), and produces an output "1" signal.

This output "1" signal is applied to the reset input of start-up flip-flop 2, thereby resetting the latter and extinguishing the start signal at its output.

First AND-gate 10, which in Situation 1 set feeding-unit flip-flop 9, does not do so in Situation 2, because it receives "1" signal (start signal) from start-up flip-flop 2, but a "0" signal from stage 8 (indicating that neither a missing sheet nor a skew sheet is present at the sheet presenting unit).

Summarizing with respect to Situation 2: The operator presses the start button 1, causing start-up flip-flop 2 to assume its set state. The presence of a skew-sheet at the sheet-presenting unit is detected, and this detection causes the start-up flip-flop 2 to be reset, thereby extinguishing the start signal at the output of flip-flop 2. The sheet-feeding unit does not become enabled, and neither does the sheet-presenting unit.

SITUATION 3

Start-up has been commanded, and a good sheet (neither a missing hseet nor a skew sheet) is present at the sheet-presenting unit of the printing machine. Specifically:

The operator presses start button 1. causing start-up flip-flop 2 to assume its set state and generate a "1" output signal.

Stage 8 produces a "0" signal on its left output (because a missing sheet has not been detected at the sheet-presenting unit), and also a "0" signal on its right output (because a skew sheet has not been detected at the sheet-presenting unit).

The "1" signal from flip-flop 2 (the start signal) is transmitted via second OR-gate 16 to the left input of second AND-gate 11.

The middle (inverting) input of AND-gate 11 receives from stage 8 a "0" signal indicating that a skew sheet has not been detected.

The right (inverting) input of AND-gate 11 receives from stage 8 a "0" signal indicating that a missing sheet has not been detected.

In other words, the middle and right inputs of AND-gate 11 receive signals together indicating that a good sheet has been detected at the sheet-presenting unit.

As a result, AND-gate 11 produces an output "1" signal.

This output "1" signal is applied to the set input of presenting-unit flip-flop 18. Flip-flop 18 is not immediately set, but becomes set upon receit of a clock pulse at its clock input $C_2$.

The "1" output signal of presenting-unit flip-flop 18 is applied to the activating means of the sheet-presenting unit of the printing machine 6, and the sheet-presenting unit is enabled for activation.

Additionally, the "1" output signal of flip-flop 18 is applied to the set input of feeding-unit flip-flop 9. Flip-flop 9 does not become set immediately, but does become set when flip-flop 9 receives the next clock pulse at its clock input $C_3$.

As a result, the sheet-feeding unit is now permitted to operate.

The "1" output signal at the output of feeding-unit flip-flop 9, as before, resets start-up flip-flop 2, thereby extinguishing the start signal, which is no longer necessary since start-up has now commenced.

Also as before, the "1" output signal at the output of feeding-unit flip-flop 9 is applied to logic circuit 4, to effect a switchover of the logic circuit 4, from the mode thereof wherein circuit 4 determines whether start-up should be permitted, to the mode thereof wherein circuit 4 determines whether operation subsequent to start-up should be permitted to continue. (This latter mode is described below).

Summarizing with respect to Situation 3: The operator presses start button 1, causing start-up flip-flop 2 to assume its set state. Stage 8 fails to indicate a missing sheet and fails to indicate a skew sheet at the sheet-presenting unit, thereby indicating a good sheet at the sheet-presenting unit. The sheet-presenting unit is permitted to operate. After the elapse of a time interval determined by the clocking pulses, the sheet-feeding unit likewise is permitted to operate.

SITUATION 4

Operation subsequent to start-up is occurring, and a missing sheet or skew sheet is detected at the sheet-presenting unit of the printing machine. Specifically:

During operation of the printing machine subsequent to start-up, stage 8 produces a "1" signal at one or the other of its outputs, indicating the presence at the sheet-presenting unit of either a skew sheet or a missing sheet.

First OR-gate 15, whose inputs are connected to receive both output signals of stage 8, generates an output "1" signal, indicating that either a skew sheet or a missing sheet has been detected.

The "1" output signal from OR-gate 15 is applied to the right input of third AND-gate 12.

Because operation subsequent to start-up is in progress, the left input of third AND-gate 12 receives a "1" signal from the output of feeding-unit flip-flop 9.

As a result, AND-gate 12 produces a "1" output signal. This signal indicates that, during operation subsequent to start-up, a missing sheet or skew sheet has been detected at the sheet-presenting unit.

This "1" output signal is applied to the reset inputs of both the feeding-unit flip-flop 9 and the presenting-unit flip-flop 18. These two flip-flops do not become reset immediately, but do become reset upoon receipt of clock pulses at their respective clock inputs $C_2$ and $C_3$.

As a result, further operation of the sheet-feeding unit and of the sheet-presenting unit is prevented.

Summarizing with respect to Situation 4: During operation of the machine subsequent to start-up, the presence of a missing sheet or a skew sheet at the sheet-presenting unit is detected. In response to such detection, the activating means of the sheet-feeding unit and of the sheet-presenting are disabled and further operation of the two units thereby prevented.

SITUATION 5

Operation subsequent to start-up is in progress, and a good sheet (neither a missing sheet nor a skew sheet) is detected as being present at the sheet-presenting unit of the printing machine. Specifically:

During operation subsequent to start-up, stage 3 detects neither a missing sheet nor a skew sheet at the sheet-presenting unit. Accordingly, the outputs of stage 8 both carry "0" signals, indicating the presence of a good sheet.

The middle and right inputs of second AND-gate 11 (both inverting inputs) receive the two "0" signals together indicative of a good sheet.

The left input of AND-gate 11 is in receipt of a "1" signal from the output of feeding-unit flip-flop 9, this "1" signal indicating that operation subsequent to start-up is in progress.

Accordingly, AND-gate 11 generates a "1" output signal.

This "1" output signal from AND-gate 11 is applied to the set input of presenting-unit flip-flop 18. Because flip-flop 18 is a clocked flip-flop, its state does not become dependent upon this "1" signal applied to its set input until it receives a clock pulse at its clock input $C_2$. Upon receipt of the clock pulse, presenting-unit flip-flop 18 becomes set, if it is not already in its set state.

When flip-flop 18 is in its set state, its output "1" signal is applied to the set input of feeding-unit flip-flop 9. Because flip-flop 9 is a clocked flip-flop, its state does not become dependent upon this "1" signal at its set input until it receives a clock pulse at its clock input $C_3$. Upon receipt of the clock pulse, flip-flop 9 becomes set, if it is not already in its set state.

Summarizing with respect to Situation 5: During operation of the machine subsequent to start-up, the detection of a good sheet at the sheet-presenting unit of the printing machine results in no interruption of operation.

Figure 3:
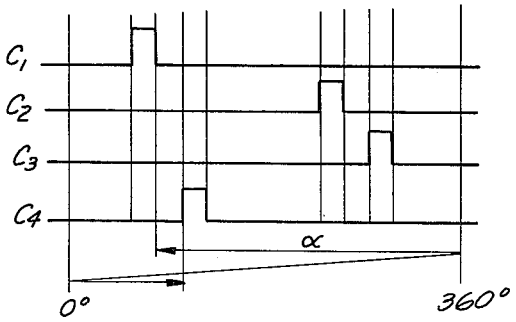
FIG. 3 is a pulse diagram showing the timing of the four clock pulse trains used to control the clocked devices in the illustrated control systems.

The clock pulses applied to clock inputs $C_1$ to $C_3$ are depicted in FIG. 3. They are generated by a conventional mechanical synchronizer, for example by or in cooperation with a one-revolution clutch provided in the printing machine.

When operation of the sheet-feeding unit and/or of the sheet-presenting unit is to be terminated, the operator of the machine activates a (non-illustrated) pushbutton, or the like, for resetting one or both of flip-flops 9 and 18.

The combinations of conditions constituting the five situations described are tabulated in FIG. 8, to which attention is directed.

As already mentioned briefly above, the logic circuit 4 has two modes of operation, the first related to start-up, the second related to operation subsequent to start-up. In its first mode, circuit 4 determines, in response to depression of start button 1, whether start-up should be permitted. In its second mode, circuit 4 determines whether operation subsequent to start-up should be permitted to continue. The switchover from the first mode to the second is dependent upon the states of start-up flip-flop 2 and feeding-unit flip-flop 9.

During the pre-start-up phase, feeding-unit unit flip-flop 9 is caused to assume its set state only in two situations, one when a missing sheet has been detected at the sheet-presenting unit, the other when neither a missing sheet nor a skew sheet has been detected at the sheet-presenting unit (i.e., when a good sheet is present at the sheet-presenting unit). Upon detection of a good sheet at the sheet-presenting unit, and in accordance with the clock pulse diagram of FIG. 3, first the presenting-unit flip-flop 18 is set and thereafter the feeding-unit flip-flop 9 is set. Upon detection of a missing sheet at the sheet-presenting unit, the operations are reversed — i.e., first the feeding-unit flip-flop 9 is set and thereafter the presenting-unit flip-flop 18 is set — because the presenting-unit flip-flop 18 does not become set until there has been a detection of a good sheet (detection of neither a missing sheet nor a skew sheet).

During the pre-start-up phase, detection of a skew sheet results in the resetting of start-up flip-flop 2, so that sheet transport is not even initiated.

During operation subsequent to start-up, both the presenting-unit flip-flop 18 and the feeding-unit flip-flop 9 become set in response to detection of neither a missing sheet nor a skew sheet (detection of a good sheet), and these flip-flops become reset in response to detection of either a missing sheet or a skew sheet.

As already indicated, the circuit diagram in FIG. 2 corresponds to that part of FIG. 1 described earlier. However, the simplified schematic circuit of FIG. 1 also includes an additional part. This additional part includes means 19 for making the control of the operation of the feeding and presenting units furthermore dependent upon detection of multiple sheets. This means 19 is comprised of a multiple-sheet detecting stage 20 and an addition 21 to logic circuit 4, for the implementation of additional situation recognition possibilities relating to the presence or absence of multiple sheets at the sheet-presenting unit.

Figure 4:
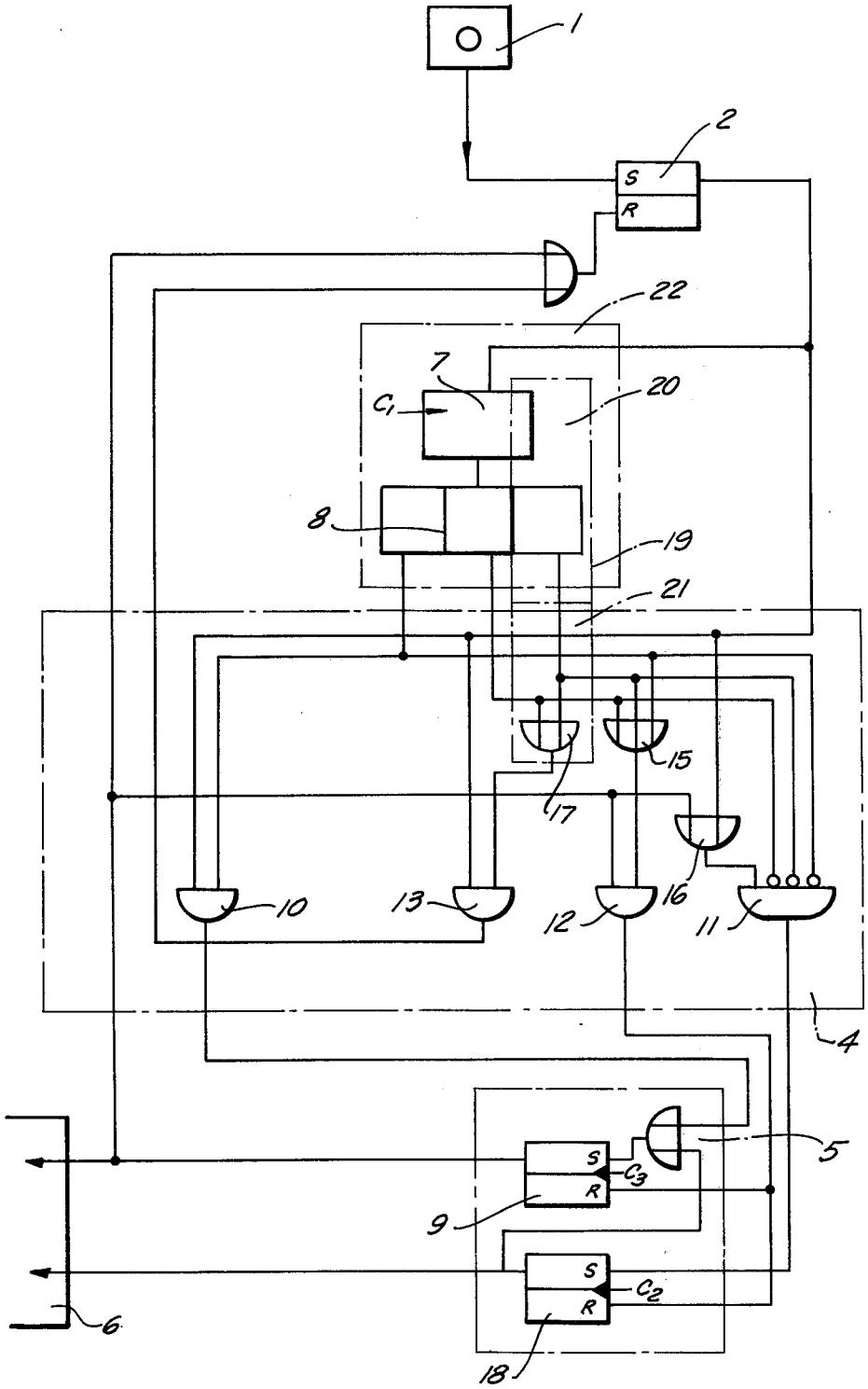
FIG. 4 is a detailed circuit diagram of the base control system shown in FIG. 1, including details of one expansion of the system.

FIG. 4 depicts the control system circuit of FIG. 2, already described, but with the addition of the just-mentioned circuitry 19, 20 and 21 for the processing of information relating to the presence of multiple sheets at the sheet-presenting unit.

Specifically, in FIG. 4, the detector stage 7 is additionally capable of detecting the presence of a multiple sheet at the sheet-presenting unit. Likewise, stage 8 is here provided with a third output (the rightmost one) upon which appears a "1" signal in response to the detection of a multiple sheet.

In FIG. 4 the logic circuit 4 of FIG. 2 has been expanded by the inclusion of a third OR-gate 11, operative for generating an output signal in response to detection of either a skew sheet or a multiple sheet. Also, second AND-gate 11 has been provided with an additional inverting input (the second one from the right) connected to the multiple-sheet signal output of stage 8.

As a result of these additions to the detecting and logic circuitry in FIG. 4, the presenting-unit flip-flop 18 will become set only when there is no missing sheet and no skew sheet and no multiple sheet at the sheet-presenting unit and, concurrently with such detected preconditions, the start-up flip-flop 2 is in its set state (Situation 3*a*) or else the feeding-unit flip-flop 9 is in its set state (Situation 5*a*). Situations 3*a* and 5*a* correspond to Situations 3 and 5 above, except for the additional precondition concerning the presence or absence of a multiple sheet.

The circuit of FIG. 4 differs from that of FIG. 2 in a further respect. First OR-gate 15 is provided in FIG. 4 with a further input, connected to the "multiple-sheet" signal output of stage 8. Accordingly, the third AND-gate 12 will reset the feeding-unit flip-flop 9 and the presenting-unit flip-flop 18 in response to detection of a missing-sheet or a skew sheet or a multiple sheet (Situation 4*a*, otherwise corresponding to Situation 4).

The resetting of the start-up flip-flop 2 by means of the output "1" signal from fourth AND-gate 13 occurs in response to detection of either a skew sheet or a multiple sheet (Situation 2*a*, otherwise corresponding to Situation 2).

A further expansion of the control system is possible. This is respresented in the simplified circuit diagram of FIG. 1 by the additional stage 23. The corresponding circuit is shown in detail in FIG. 5, which corresponds to FIG. 4, except for this still further expansion of the system.

Figure 5:
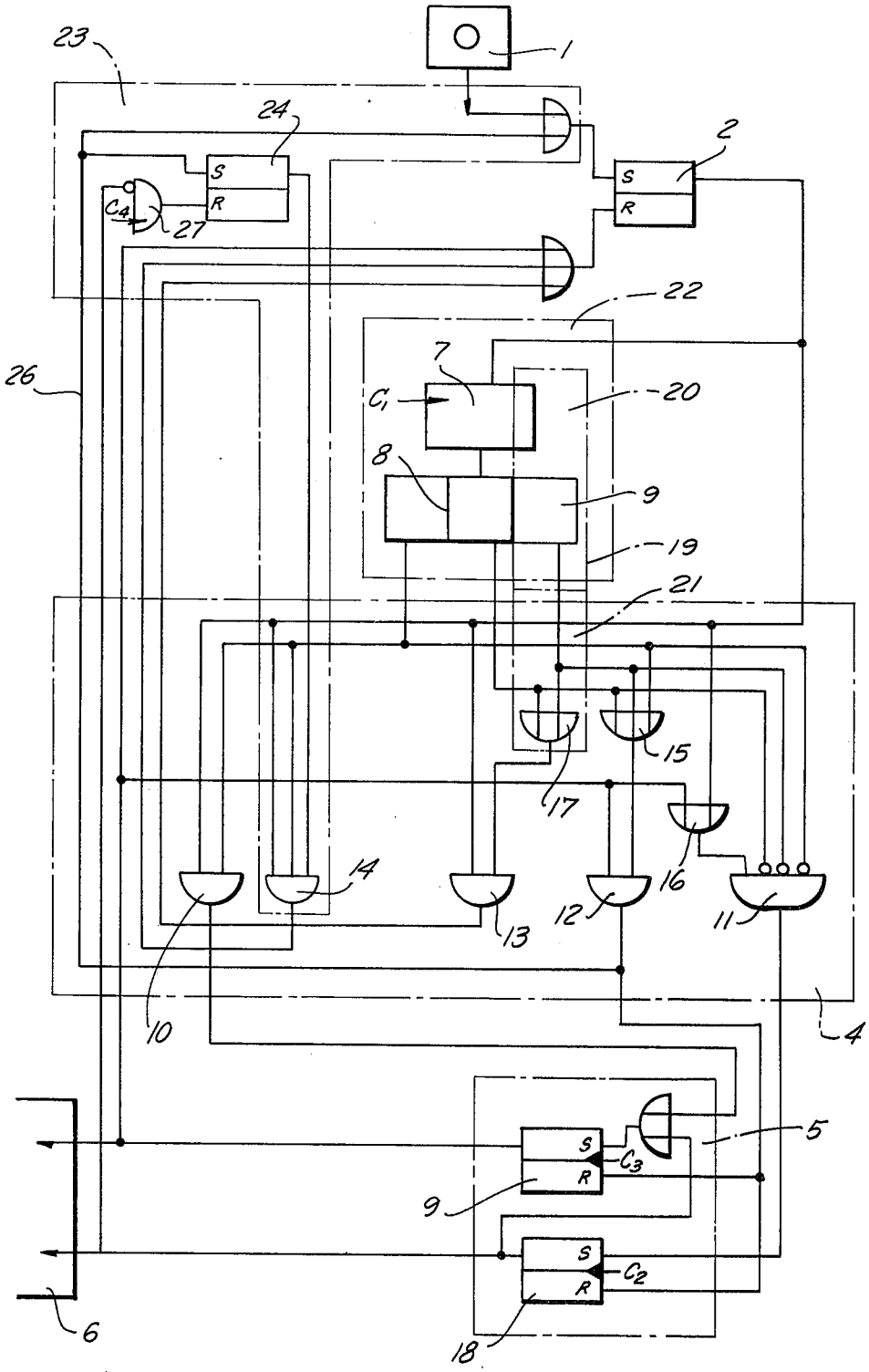
FIG. 5 is a detailed circuit diagram of the base control system shown in FIG. 1, including details of both the system expansions indicated in FIG. 1.

In FIG. 5, this first additional circuit stage is operative, in response to detection of a skew sheet and/or a multiple sheet, for causing the sheet-feeding unit to skip at least one of its operating cycles. Either one or else a preselected number of operating cycles greater than one can be skipped by the sheet-feeding unit. When the sheet-feeding unit is driven by a one-revolution coupling, the number of operating cycles of the sheet-feeding unit can be expressed in terms of the number of revolutions of such one-revolution coupling.

The expedient of causing the sheet-feeding unit to skip a predetermined number of its operating cycles is based upon the fact that a skew sheet or a multiple sheet may, during the skipped operating cycle of the sheet-feeding unit, become converted into a good sheet, whether by straightening-out or separation. Of course, this is not the case where the bad sheet is a missing sheet; there is no possibility that a missing sheet will become converted into a good sheet during the skipped operating cycle of the sheet-feeding unit. Thus, in the case of either a skew sheet or a multiple sheet immediate termination of sheet transport does not constitute the optimum expedient, whereas in the case of the detection of a missing sheet during post-start-up operation sheet transport should be discontinued.

With respect to FIG. 5, the first additional circuit stage 23 includes a flip-flop 24 operative for registering a signal for a time interval corresponding to a predetermined number of operating cycles (one or more) of the sheet-feeding unit, for example as expressed by the number of revolutions of the one-revolution coupling driving the sheet-feeding unit, if the sheet-feeding unit is driven in that manner. The first additional circuit stage 23 furthermore includes an addition to the logic circuit 4 (indicated by 25 in FIG. 1), having in FIG. 5 the form of a fifth AND-gate 14 and a connection 26 between the output of the third AND-gate 12 and the set inputs of flip-flops 24 and 2.

The operation of the additional circuit stage 23 will be explained with reference to the overall circuit shown in FIG. 5.

Specifically, the circuit of FIG. 5 operates in the same way as that of FIG. 4, with the following exception.

If, during sheet transport subsequent to start-up, the feeding-unit flip-flop 9 and the presenting-unit flip-flop 18 are reset in response to detection of a missing sheet or a skew sheet or a multiple sheet both the skip-cycle flip-flop 24 and the start-up flip-flop 2 are caused to assume their set states, and are kept in the set state for the predetermined number of skipped operating cycles of the sheet-feeding unit (one or greater than one, here one), expressed in terms of the number of revolutions of the one-revolution coupling during which the one-revolution coupling is caused to skip engagement with the feeding unit.

Depending upon what happens thereafter, different operations are performed. In the case of the detection of a missing sheet, the feeding-unit flip-flop 9 becomes reset upon receipt of the next clock pulse $C_3$. Previous to that, in correspondence to the evaluation performed by third AND-gate 12, the start-up flip-flop 2 and the skip-cycle flip-flop 24 were caused to assume their set states. However, since in the case of a missing sheet further operation of the machine is not of advantage, the fifth AND-gate 14 resets the start-up flip-flop 2 immediately. In this way, further operation of the machine is prevented (as in Situation 4).

In the case of the detection of a skew sheet and/or a multiple sheet, the sequence of operations is the same as already described — i.e., the sheet-feeding unit and the sheet-presenting unit are disabled (as in Situation 4).

In the case of the detection of a good sheet, the feeding-unit flip-flop 9 and the presenting-unit flip-flop 18 are caused to again assume their set states, and sheet transport resumes (as in start-up Situation 3). Specifically, if the skew sheet or multiple sheet has meanwhile been coverted into a good sheet, "1" signal appears at the output of AND-gate 11, applying a set signal to presenting-unit flip-flop 18, which becomes set upon the receipt of the next clock pulse $C_2$, whereupon the activating means of the sheet-presenting unit becomes re-enabled. With the presenting-unit flip-flop 18 again in its set state, its ouput "1" signal is applied to the set input of feeding-unit flip-flop 9, which becomes set upon receipt of the next clock pulse $C_3$, whereupon the activating means of the sheet-feeding unit becomes re-enabled.

In other words, in the embodiment of FIG. 5, if during post-start-up operation a bad sheet is detected, the flip-flops 9 and 18 become reset, and the start-up flip-flop becomes set. If the bad sheet is a missing sheet, the just-set start-up flip-flop is immediately reset. If the bad sheet was either a skew sheet or a multiple sheet, the start-up flip-flop is maintained in its set state until after the next clock pulse $C_1$ for the detector stage. If, upon receipt of this next clock pulse $C_1$, the detector stage informs AND-gate 11 that the skew sheet or multiple sheet has meanwhile been converted into a good sheet, AND-gate 11 sets flip-flop 18, which in turns sets flip-flop 9, and sheet transport is thus resumed.

If it happens that the construction of the printing machine is such that the sheet-feeding unit cannot be thrown into engagement at full speed, the circuit would be modified to maintain skip-cycle flip-flop 24 set for a plurality of revolutions of the coupling and the feeding unit will be thrown into engagement when the primary operating speed is reached.

In any event, the registration of a signal by skip-cycle flip-flop 24 for a period corresponding to one revolution of the coupling is accomplished by the particular manner in which flip-flop 24 is reset. Presenting-unit enablement flip-flop 18 is reset upon receipt of a clock pulse $C_2$ (see FIG. 3). The resetting of skip-cycle flip-flop 24 is effected via a sixth AND-gate 27 by a clock pulse $C_4$ (see FIG. 3) but not until the presenting-unit flip-flop 18 is reset. What results is an extension of time corresponding to a rotation angle $\alpha = 2\pi$ of the one-revolution clutch (see FIG. 3).

Figure 6:
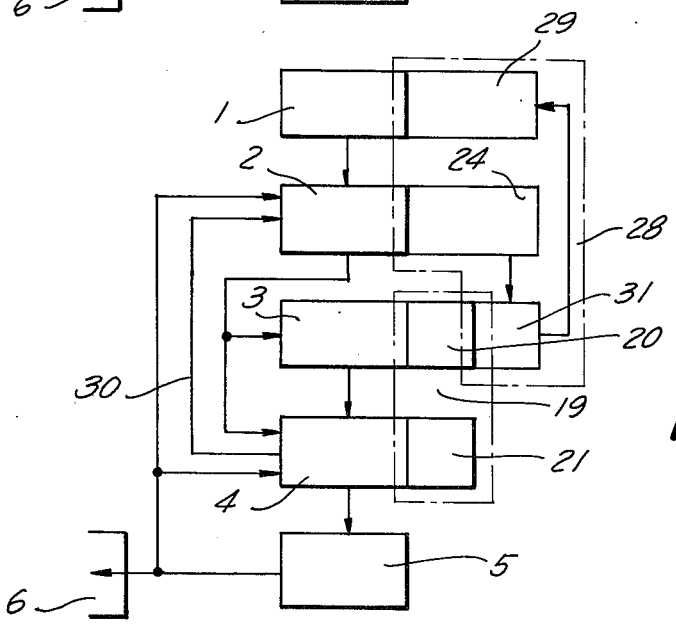
FIG. 6 is a simplified circuit diagram of an exemplary sheet transport control system, including the same base control system as in FIG. 1, but with a different expansion of the system.

As indicated above, FIG. 1 is a simplified circuit diagram, the base circuit of which is shown in detail in FIG. 2; the base circuit with the addition of stage 19 is shown in FIG. 4; the base circuit with the addition of stages 19 and 23 is shown in FIG. 5 FIG. 6 is a corresponding simplified circuit diagram, showing the same base circuit as in FIG. 1, with the same additional stage 19 as shown in FIG. 1, but with the first additional stage 23 of FIG. 1 replaced by a different second additional stage 28.

Figure 7:
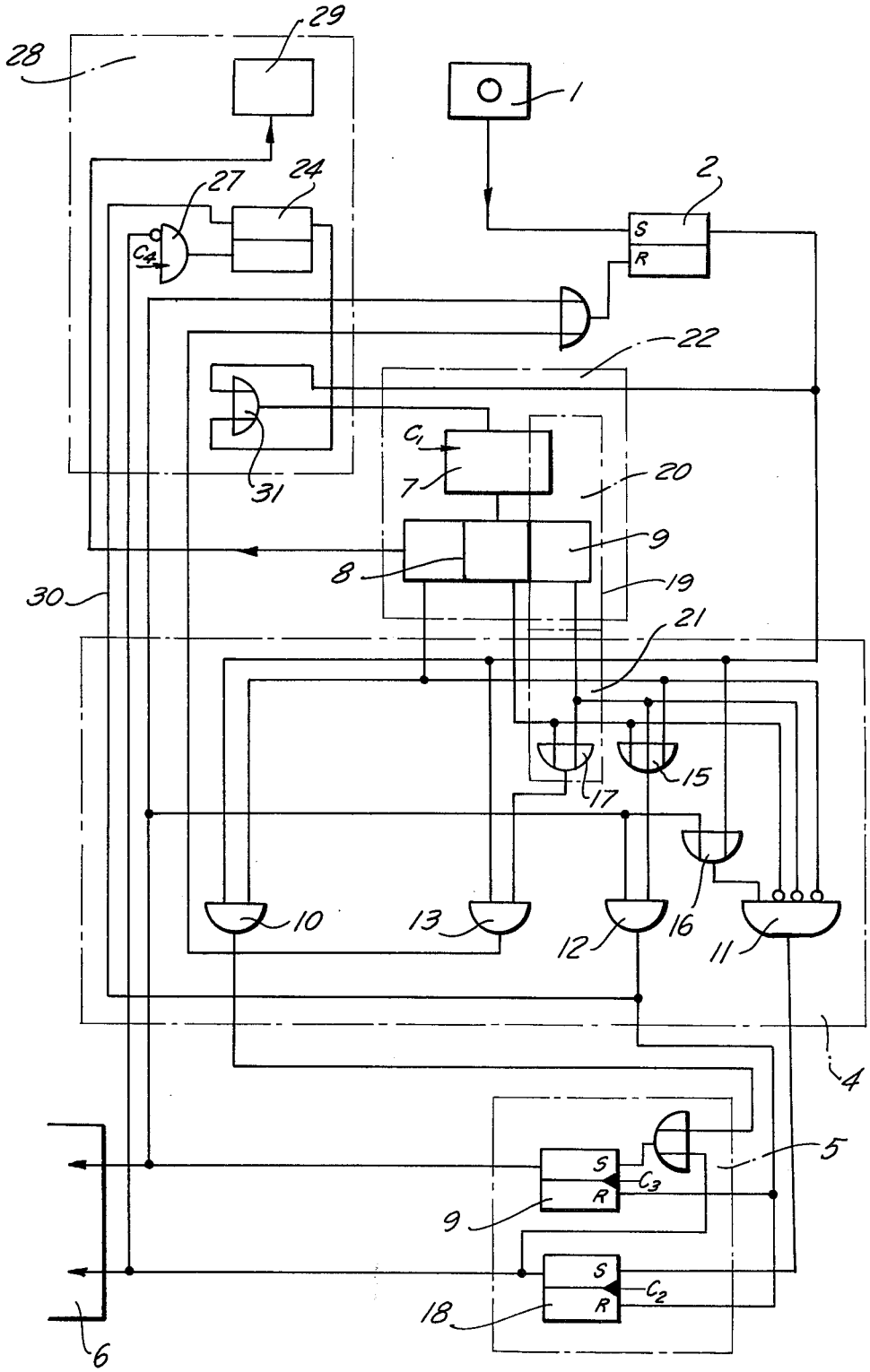
FIG. 7 is a detailed circuit diagram of the system of FIG. 6, showing details of both the base system and the system expansion.

The simplified circuit diagram of FIG. 6, with both additional stages 19 and 28, is shown in detail in FIG. 7.

Second additional stage 28 of FIG. 7 (replacing first additional stage 23 of FIG. 5) is comprised again of a time-delay flip-flop 24, and of a connection 30 between the logic circuit 4 and time-delay flip-flop 24, an indicator device 29, and an additional logic-circuit stage 31 for detection of missing sheets, skew sheets and multiple sheets.

The control system circuit of FIG. 7 operates as follows:

If, during post-start operation, a missing sheet, a skew sheet or a multiple sheet is detected, AND-gate 12 effects resetting of feeding-unit flip-flop 9 and presenting-unit flip-flop 18. Additionally, AND-gate 12 effects setting of time-delay flip-flop 24, via connection line 30. Flip-flop 24 can only be reset by a signal from a sixth AND-gate 27. Flip-flop 24 when it is set in this manner, becomes set during receipt of a clock pulse $C_1$ and remains set until it is reset by flip-flop 18 (which itself becomes reset upon the next clock pulse $C_2$) and AND-gate 27 upon generation of the next clock pulse $C_4$. When flip-flop 24 thusly becomes set, its output "1" signal is applied via a fourth OR-gate 31 to measuring stage 7, and is utilized as an axuiliary clocking signal, causing the output signals of detector stage 8 to change in correspondence to any change occurring with respect to the bad sheet character of the detected sheet. The information received by detector stage 8 from stage 7 is furnished to an indicator 29, which provides the operator of the machine with an indication of whether or not the bad sheet which triggered the resetting of flip-flops 9, 18 has meanwhile become converted into a good sheet. Depending upon whether a conversion from bad sheet to good sheet has occurred, and/or depending upon the type of bad sheet indicated if a conversion to a good sheet has not occurred, the operator will initiate what he judges to be an appropriate operation; for example, based upon the recent operation of the machine, he may be decide to remove the bad sheet, or in the case of a missing sheet he may decide to again activate the start button in the hope that the sheet transport will thereafter proceed properly. In the embodiment of FIG. 7, unlike that of FIG. 5, the start-up flip-flop 2 is not automatically set in response to detection of a bad sheet.

It will be understood that each of the elements described above, or two or more together, may also find a useful application in other types of circuits and constructions differing from the types described above.

While the invention has been illustrated and described as embodied in a particular type of sheet transport control system, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a printing machine of the type including a sheet-presenting unit which presents received sheets to the printing means of the machine, a sheet-feeding unit which feeds sheets to the sheet-presenting unit, and enableable activating means for the sheet-feeding and sheet-presenting units, a sheet transportcontrol system comprising, in combination, user-activatable starter means operative when activated for generating a start signal; sheet-detecting means operative for determining whether a missing sheet or a skew sheet is present at the sheet-presenting unit and generating corresponding missing sheet and skew sheet sheet-condition signals; enablement storage means operative when activated for enabling the activating means of the sheet-feeding and sheet-presenting units; means automatically operative for terminating the start signal when the enablement storage means is activated; and logic circuit means connected to receive the start and sheet-condition signals and having a pre-start-up and a post-start-up mode of operation corresponding to generation and termination of the start signal, operative in the pre-start-up mode for activating the enablement storage means in response to the presence of a missing-sheet signal and in response to the concurrent absence of missing-sheet and skew-sheet signals, and operative in the post-start-up mode for maintaining the enablement storage means activated in response to the concurrent absence of missing-sheet and skew-sheet signals.

2. In a printing machine as defined in claim 1, the enableable activating means for the sheet-feeding and sheet-presenting units including an enableable feeding-unit activating means and an enableable presenting-unit activating means, the enablement storage means including feeding-unit enablement storage means operative when activated for enabling the feeding-unit activating means and presenting-unit enablement storage means operative when activated for enabling the presenting-unit activating means, the logic circuit means including means operative in the post-start-up mode for responding to receipt of a skew-sheet signal by deactivating the feeding-unit enablement storage means for a time period corresponding to a preselected number of feeding-unit operating cycles equal to or greater than one.

3. In a printing machine as defined in claim 1; further including indicating means connected to the sheet-detecting means and operative for providing the user of the machine with indication of the detected sheet condition, the logic circuit means including means operative in the post-start-up mode for responding to receipt of missing sheet and skew-sheet signals by causing the indicating means to indicate any change of the condition of the detected missing sheet or skew sheet occurring during a predetermined time interval subsequent to detection of the missing sheet or skew sheet, the predetermined time interval corresponding to a preselected number of feeding-unit operating cycles equal to or greater than one.

4. In a printing machine as defined in claim 1, the user-activatable starter means including a start-up flip-flop and a user-activatable starter member operative when activated for setting the start-up flip-flop, the enablement storage means comprising a feeding-unit enablement flip-flop and a presenting-unit enablement flip-flop, the sheet-detecting means having a missing-sheet signal output and a skew-sheet signal output, the logic circuit means including first, second, third and fourth AND-gates and first and second OR-gates, the first AND-gate having an output connected to the set input of the feeding-unit enablement flip-flop an input connected to the output of the start-up flip-flop and another input connected to the missing-sheet signal output, the first OR-gate having an input connected to the missing-sheet signal output and another input connected to the skew-sheet signal output, the second OR-gate having an input connected to the output of the start-up flip-flop and another input connected to the output of the feeding-unit enablement flip-flop, the second AND-gate having a non-inverting input connected to the output of the second OR-gate and an inverting input connected to the missing-sheet signal output and another inverting input connected to the skew-sheet signal output, the third AND-gate having an output connected to the reset input of the feeding-unit enablement flip-flop and an input connected to the output of the feeding-unit enablement flip-flop and another input connected to the output of the first OR-gate, the fourth AND-gate having an output connected to the reset input of the start-up flip-flop and having an input connected to the output of the start-up flip-flop and another input connected to the skew-sheet signal output, the means for terminating the start signal comprising means connecting the output of the feeding-unit enablement flip-flop to the reset input of the start-up flip-flop, the enablement storage means furthermore including means connecting the output of the presenting-unit enablement flip-flop to the set input of the feeding-unit enablement flip-flop.

5. In a printing machine as defined in claim 1, the enablement storage means comprising a feeding-unit enablement flip-flop operative when set for enabling the feeding-unit activating means and a presenting-unit enablement flip-flop operative when set for enabling the presenting-unit activating means, the sheet-detecting means and the feeding-unit and presenting unit flip-flops all being clocked devices having clock-signal inputs for receipt of clock pulses generated in synchronism with printing machine operation.

6. In a printing machine as defined in claim 1, the sheet-detecting means comprising means for additionally determining whether a multiple sheet is located at the sheet-presenting unit and generating a corresponding multiple-sheet sheet-condition signal, the logic circuit means receiving the multiple-sheet signals, the logic circuit means being operative in the pre-start-up mode for activating the enablement storage means in response to the presence of a missing-sheet signal and in response to the concurrent absence of missing-sheet, skew-sheet and multiple-sheet signals, and operative in the post-start-up mode for maintaining the enablement storage means activated in response to the concurrent absence of missing-sheet, skew-sheet and multiple-sheet signals.

7. In a printing machine as defined in claim 4, the sheet-detecting means comprising means for additionally determining whether a multiple sheet is located at the sheet-presenting unit and generating a corresponding multiple sheet signal at a multiple-sheet signal output, the first OR-gate having a further input connected to the multiple-sheet signal output, the second AND-gate having a further inverting input connected to the multiple-sheet signal output, the logic circuit means additionally including a third OR-gate having an input connected to the skew-sheet signal output and another input connected to the multiple-sheet signal output and having an output connected to the aforementioned other input of the fourth AND-gate.

8. In a printing machine as defined in claim 4, the logic circuit means additionally including a skip-cycle flip-flop, means connecting the output of the third AND-gate to the set inputs of the start-up and skip-cycle flip-flops, a fifth AND-gate having an input connected to the output of the skip-cycle flip-flop and another input connected to the output of the start-up flip-flop and a further input connected to the missing-sheet signal output and having an output connected to the reset input of the start-up flip-flop.

9. In a printing machine as defined in claim 4; further including indicating means connected to the sheet-detecting means and operative for providing the user of the machine with an indication of the detected sheet condition, the logic circuit means including additional means operative in the post-start-up mode for responding to receipt of missing-sheet and skew sheet signals by causing the indicating means to indicate any change of the condition of the detected missing sheet or skew sheet occurring during a predetermined time interval subsequent to detection of the missing sheet or skew sheet, the predetermined time interval corresponding to a preselected number of feeding-unit operating cycles equal to or greater than one, said additional means comprising a time-delay flip-flop, means connecting the output of the third AND-gate to the set input of the time-delay flip-flop, and an additional OR-gate having an input connected to the output of the time-delay flip-flop and another input connected to the output of the start-up flip-flop and an output connected to the sheet-detecting means for causing the indicating means to indicate the aforementioned change of condition.

* * * * *